US007234265B1

(12) United States Patent
Cheng et al.

(10) Patent No.: US 7,234,265 B1
(45) Date of Patent: Jun. 26, 2007

(54) INTERNAL RED DOT SIGHT

(76) Inventors: Li-Der Cheng, No. 1, Lane 261, Sec. 6, Yen Ping North Road, Hsichih City, Taipei Hsien (TW); Yi-Rong Lee, No. 3, Lane 130, Hsiu-Shan Road, Hsichih City, Taipei Hsien (TW)

( * ) Notice: Subject to any disclaimer, the term of this patent is extended or adjusted under 35 U.S.C. 154(b) by 0 days.

(21) Appl. No.: 11/164,853

(22) Filed: Dec. 7, 2005

(51) Int. Cl.
*F41G 1/00* (2006.01)

(52) U.S. Cl. ..... 42/113; 42/131; 42/132

(58) Field of Classification Search ..... 42/113, 42/131, 132
See application file for complete search history.

(56) References Cited

U.S. PATENT DOCUMENTS 5,493,450 A * 2/1996 Ekstrand ..... 359/799
5,594,584 A * 1/1997 Kay et al. ..... 359/433
5,724,181 A * 3/1998 Negishi ..... 359/428
6,373,628 B1 * 4/2002 Gunnarsson et al. ..... 359/428
6,967,775 B1 * 11/2005 Millett ..... 359/399

* cited by examiner

*Primary Examiner*—Michael J. Carone
*Assistant Examiner*—Gabriel J. Klein
(74) *Attorney, Agent, or Firm*—Bacon & Thomas PLLC

(57) ABSTRACT

An internal red dot sight includes an objective lens formed of a convex lens, a planar eye lens set in a tilt angle relative to the objective lens and facing the concave surface of the objective lens, and a light emitting device set in between the planar eye lens and the objective lens and controlled to emit a point light source onto the eye lens for enabling the eye lens to reflect the point light source and to further produce a virtual point light source on the focal point of the objective lens for viewing by the user.

11 Claims, 4 Drawing Sheets

INTERNAL RED DOT SIGHT

BACKGROUND OF THE INVENTION

1. Field of the Invention

The present invention relates to a sight for use in a gun or the like to guide the eyes and more particularly, to an internal red dot sight, which projects a virtual point light source onto the objective lens, simulating the parallel emission of a point light source from a remote site and, which employs coating techniques to control the percentage of red light reflection, achieving the objects of shortening the length of the internal red dot sight, increasing the size of the objective lens, reducing the manufacturing cost of the internal red dot sight, and improving the projection precision of the light source.

2. Description of the Related Art

Conventional sights for use in guns to guide the eyes include two types, namely, the internal red dot type and the external red dot type. In a battle, the sight helps the fighter to achieve fast target acquisition. A regular external red dot sight uses a laser pointer to project a laser beam directly projected onto the target, leaving a red point on the target for target acquisition. However, the location of an external red dot sight user can easily be seen. Further, when the intensity of the ambient light is high, the user may be unable to identify the red dot on the target. Internal red dot sights are developed to eliminate the aforesaid drawbacks. An internal red dot sight only uses the red (or green) dot within the sight. Because the dot is not projected to the target, the user's location will not be found, and the ambient light does not affect the presence of the dot within the sight.

FIGS. 4 and 5 show an internal red dot sight B according to the prior art. According to this design, the internal red dot sight B comprises a concave lens A having a circular arch with an angle. A centre C of the circle of the concave lens A is on the major axis, and a focal point F is on the mid point between the centre C and the concave lens A. When the red dot is projected from the focal point F to the concave lens A, the concave lens A reflects the light beam in parallel to the major axis, thereby satisfying that incident angle=angle of reflection, and therefore the user's eye can see the dot on the concave lens A that is superimposed on the target. This design is functional, however it still has drawbacks.

After installation of the internal red dot sight B in the weapon, the user must approach the eye to the concave lens A to search the reflected red dot off the concave lens A. Because only the light rays that are reflected by the convex lens A around the major axis pass in parallel to the major axis to produce a red dot, the user must aim the eye at the centre area of the concave lens A. When seeing the border area of the concave lens A, the image of the red dot becomes twisted. If the diameter of the concave lens A is made relatively smaller, the parallel light ray reflection range of the concave lens A will be relatively reduced, narrowing the effective view range. However, when increasing the diameter of the concave lens A, the distance of the focal point F will become relatively farther, and the distance between the light source and the concave lens A will also become relatively longer (see FIG. 5). In this case, the size and weight of the internal red dot sight B will be relatively increased.

There is also known an internal red dot sight that uses a laser projection technique to produce a red dot through multiple reflections of the light beam of a laser source. This design requires a precision calibration to map the red dot. Further, this design uses a big number of lenses, resulting in a high cost. If the internal red dot sight falls to the ground accidentally, the angle of reflection of the laser beam will be biased, resulting in a focusing failure. In this case, the laser beam may injure the user's eye.

Therefore, it is desirable to provide an internal red dot sight that eliminates the aforesaid problems.

SUMMARY OF THE INVENTION

The present invention has been accomplished under the circumstances in view. It is the main object of the present invention to provide an internal red dot sight, which improves the projection precision of the light source. It is another object of the present invention to provide an internal red dot sight, which greatly shortens the device length, maximizes the size of the objective lens, and reduces the product cost.

To achieve these and other objects of the present invention, the internal red dot sight comprises an objective lens formed of a convex lens, a planar eye lens set in a tilt angle relative to the objective lens and facing the concave surface of the objective lens, and a light emitting device set in between the planar eye lens and the objective lens and controlled to emit a point light source onto the eye lens for enabling the eye lens to reflect the point light source and to further produce a virtual point light source on the focal point of the objective lens for viewing by the user. Further, by means of employing coating techniques to the eye lens and the objective lens, the reflected percentage of the red light of the point light source is controlled.

DETAILED DESCRIPTION OF THE PREFERRED EMBODIMENT

Figure 1:
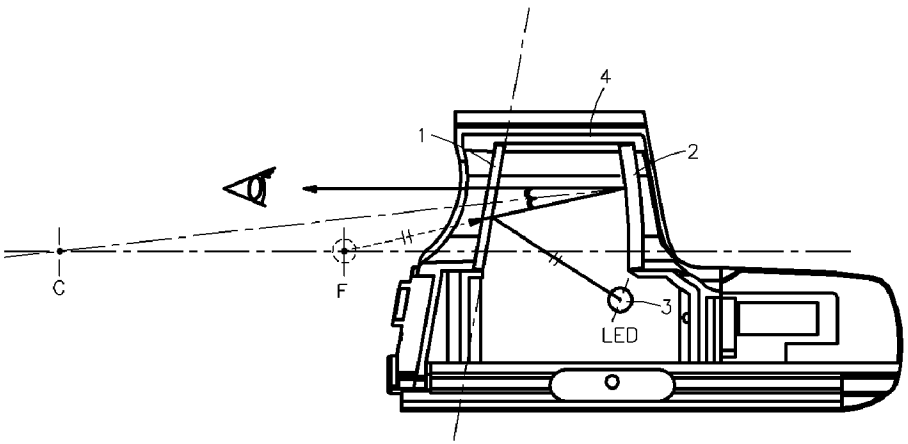
FIG. 1 is a schematic side view showing the arrangement of an eye lens, an objective lens and a light emitting device in an internal red dot sight according to the present invention.
Figure 2:
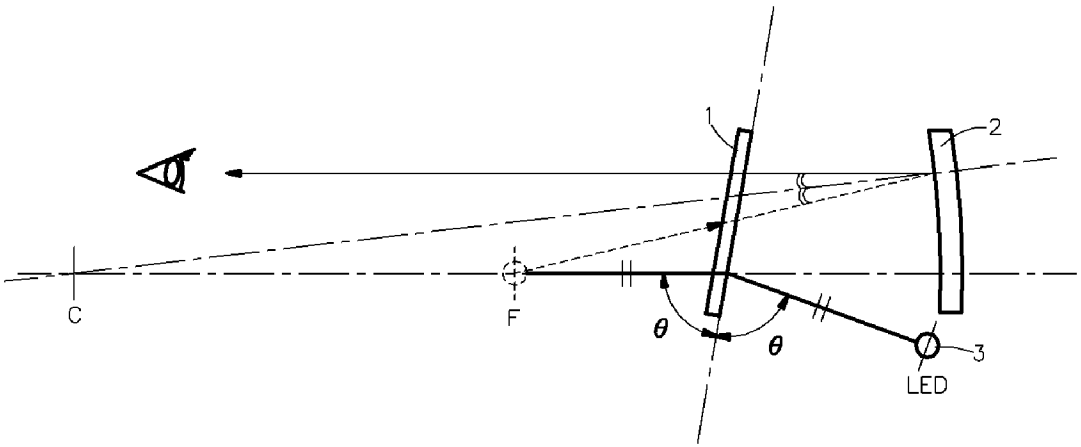
FIG. 2 is a schematic drawing explaining the operation of the present invention (I).

Referring to FIGS. 1 and 2, an internal red dot sight 4 is shown comprised of an eye lens 1, an objective lens 2, and a light emitting device 3 adapted to emit light in between the eye lens 1 and the objective lens 2. The eye lens 1 is a planar lens. The objective lens 2 is a concave lens. The eye lens 1 is set in a tilt angle relative to the objective lens 2. When the light emitting device 3 is operated to emit light toward the eye lens 1, the eye lens 1 reflects a point light source of the light emitting device 3, thereby forming a virtual point light source on an major axis of the objective lens 2 subject to the law that incident angle=angle of reflection. At this time, this distance between the point light source of the light emitting device 3 and the eye lens 1 is equal to the distance between the virtual point light source and the eye lens 1. Therefore, the virtual point light source is allocated at a focal point F of the objective lens 2, and a light ray is projected to the objective lens 2 in parallel to the major axis by means of the virtual point light source. By means of the aforesaid arrangement, the point light source actually emitted by the light emitting device 3 is simulated to be allocated onto the focal point F of the objective lens 2, and then projected onto the objective lens 2 by means of the virtual point light source and then sent out of the objective lens 2 in parallel to the major axis. The dot on the lens is superimposed on the target. According to this structural design, the length of the internal red dot sight 4 is simply the distance between the eye lens 1 and the objective lens 2. Further, because the light emitting device 3 is provided in between the eye lens 1 and the objective lens 2, the total length of the internal red dot sight 4 is minimized.

Figure 3:
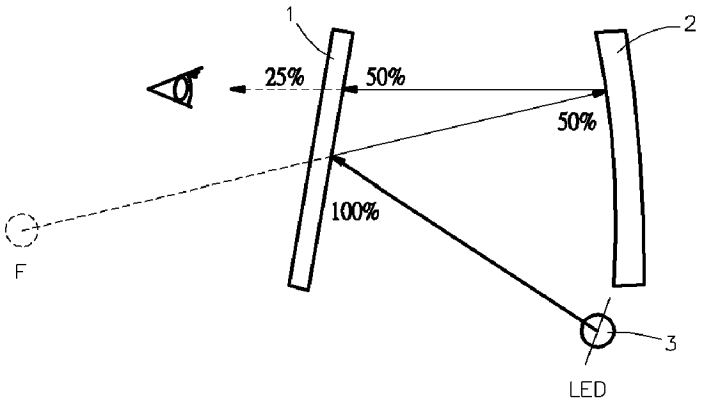
FIG. 3 is a schematic drawing explaining the operation of the present invention (II).
Figure 4:
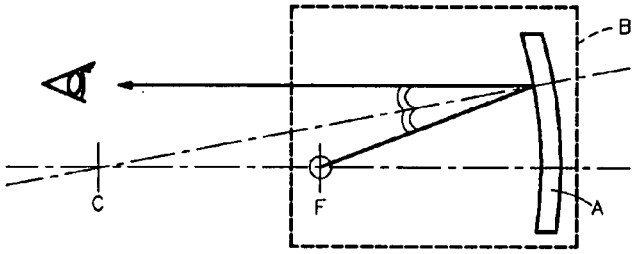
FIG. 4 is a schematic drawing explaining the operation of an internal red dot sight according to the prior art (I).
Figure 5:
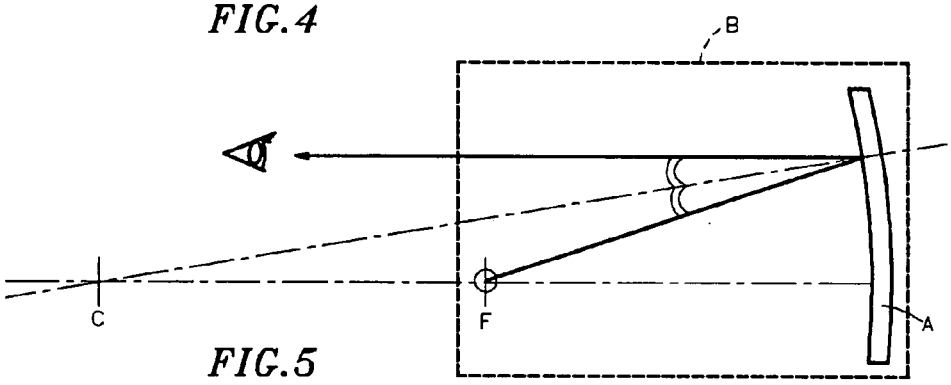
FIG. 5 PRIOR ART
FIG. 5 is a schematic drawing explaining the operation of an internal red dot sight according to the prior art (II).

Further, in order to fit the double projection effect of the aforesaid design, we can coat a reflecting film 11 on one surface, namely, the rear surface of the eye lens 1 that faces the objective lens 2. The reflecting film 11 reflects only the red light emitted by the light emitting device 3. The red light wavelength can be set to be 635 nm. Through the reflecting film 11, the red light reflection ratio is limited. Further, the concave side of the objective lens 2 is coated with a layer of total reflection coating 21, and the opposite surface, namely, the front surface of the eye lens 1 is coated with a layer of high transmission coating 12, as shown in FIG. 3. When the light source of the light emitting device 3 is emitted onto the eye lens 1, the reflecting film 11 of the eye lens 1 reflects 50% of the red light onto the objective lens 2, and the residual 50% red light passes through the high transmission coating 12 of the eye lens 1, therefore 50% of the red light is reflected by the eye lens 1 onto the objective lens 2 and then totally reflected by the total reflection coating 21 of the objective lens 2 to pass to the eye lens 1 in parallel to the major axis. In the same manner, 25% of the totally reflected 50% red light is reflected by the reflecting film 11, and the rest 25% of the totally reflected 50% red light passes in parallel to the major axis. Because light passes linearly, the 25% red light that passes in parallel to the major axis is received by the user's eye, simulating the parallel emission of red light from a remote site.

As indicated above, the invention provides an internal red dot sight 4, which uses an eye lens 1 and an objective lens 2 to produce a double reflection effect, enabling the point light source of a light emitting device 3 to be reflected by the eye lens 1 to form a virtual point light source on the focal point F of the objective lens 2, thus the virtual point light source is projected onto the concave side of the objective lens 2 and sent out in parallel to the major axis of the objective lens 2. By means of coating techniques employed to the eye lens 1 and the objective lens 2, the percentage of the red light of the reflected point light source is controlled, thereby simulating parallel emission of a red dot from a remote site and bringing the red dot to the eye in the form of a reflection. Subject to the aforesaid principle, the eye lens 1 and the objective lens 2 are arranged inside the internal red dot sight 4, and the light emitting device 3 is set in between the eye lens 1 and the reflective lens 2. By means of the projection of the virtual point light source, the total length of the internal red dot sight 4 is greatly shortened. When wishing to increase the diameter of the objective lens 2, it simply needs to adjust the position of the point light source of the light emitting device 3 to let the reflected virtual point light source be allocated at the focal point F of the objective lens 2, thereby increasing the parallel light ray emission range and widening the view field without causing distortion of the image or image concentration problem. Therefore, the invention achieves the objects of shortening the length of the internal red dot sight 4, increasing the size of the objective lens 2, reducing the manufacturing cost of the internal red dot sight 4, and improving the projection precision of the light source.

In general, the invention provides an internal red dot sight 4, which comprises an eye lens 1, an objective lens 2, and a light emitting device 3 set in between the eye lens 1 and the objective lens 2. The light emitting device 3 emits a point light source onto the eye lens 1, which reflects the point light source to form a virtual point light source on the focal point F of the objective lens 2, enabling the virtual point light source to be projected onto the objective lens 2, and therefore the red light is brought back to the eye in the form of a reflection. By means of employing coating techniques to the eye lens 1 and the objective lens 2, the reflected percentage of the red light of the point light source is controlled.

A prototype of internal red dot sight has been constructed with the features of FIGS. 1~3. The internal red dot sight functions smoothly to provide all of the features discussed earlier.

Although a particular embodiment of the invention has been described in detail for purposes of illustration, various modifications and enhancements may be made without departing from the spirit and scope of the invention.

What is claimed is:

1. An internal red dot sight comprising an objective lens formed of a convex lens, said objective lens having a concave surface, an eye lens formed of a planar lens and set in a tilt angle relative to said objective lens and facing the concave surface of said objective lens, and a light emitting device set in between said eye lens and said objective lens and arranged to emit a point light source toward said eye lens such that said eye lens reflects said point light source to further produce a virtual point light source on a focal point of said objective lens for viewing by the user.

2. The internal red dot sight as claimed in claim 1, wherein said eye lens has a first surface facing the concave surface of said objective lens and coated with a layer of reflecting film and a second surface opposite to said first surface is coated with a layer of high transmission coating.

3. The internal red dot sight as claimed in claim 2, wherein said reflecting film is adapted to reflect a red light of the point light source from said light emitting device subject to a predetermined percentage.

4. The internal red dot sight as claimed in claim 3, wherein said red light has a wavelength 635 nm.

5. The internal red dot sight as claimed in claim 2, wherein said high transmission coating of said eye lens is adapted to pass the total red light of the point light source being projected onto said eye lens.

6. The internal red dot sight as claimed in claim 1, wherein said concave surface of said objective lens is coated with a layer of total reflection coating.

7. An internal red dot sight comprising an objective lens formed of a convex lens, said objective lens having a concave surface, an eye lens formed of a planar lens and set in a tilt angle relative to said objective lens and facing the concave surface of said objective lens, and a light emitting device set in between said eye lens and said objective lens and adapted to emit a point light source onto said eye lens for allowing said eye lens to reflect said point light source and to further produce a virtual point light source on a focal point of said objective lens for viewing by the user, wherein said eye lens has a first surface facing the concave surface of said objective lens and coated with a layer of reflecting film and a second surface opposite to said first surface is coated with a layer of high transmission coating.

8. The internal red dot sight as claimed in claim 7, wherein said reflecting film is adapted to reflect a red light of the point light source from said light emitting device subject to a predetermined percentage.

9. The internal red dot sight as claimed in claim 8, wherein said red light has a wavelength 635 nm.

10. The internal red dot sight as claimed in claim 7, wherein said high transmission coating of said eye lens is adapted to pass the total red light of the point light source being projected onto said eye lens.

11. The internal red dot sight as claimed in claim 7, wherein said concave surface of said objective lens is coated with a layer of total reflection coating.

* * * * *